US010039955B2

(12) United States Patent
Palmer et al.

(10) Patent No.: US 10,039,955 B2
(45) Date of Patent: Aug. 7, 2018

(54) EXERCISE DEVICE AND METHOD OF USING SAME

(71) Applicants: Richard Palmer, Newbury Park, CA (US); John Pertessis, Thousand Oaks, CA (US)

(72) Inventors: Richard Palmer, Newbury Park, CA (US); John Pertessis, Thousand Oaks, CA (US)

( * ) Notice: Subject to any disclaimer, the term of this patent is extended or adjusted under 35 U.S.C. 154(b) by 0 days.

(21) Appl. No.: 15/078,469

(22) Filed: Mar. 23, 2016

(65) Prior Publication Data

US 2016/0206918 A1 Jul. 21, 2016

Related U.S. Application Data

(63) Continuation-in-part of application No. 13/932,628, filed on Jul. 1, 2013, now Pat. No. 9,295,879.
(Continued)

(51) Int. Cl.
*A63B 22/00* (2006.01)
*A63B 71/00* (2006.01)
(Continued)

(52) U.S. Cl.
CPC ..... *A63B 22/16* (2013.01); *A63B 21/023* (2013.01); *A63B 21/068* (2013.01);
(Continued)

(58) Field of Classification Search
CPC ..... A63B 2/00; A63B 21/068; A63B 21/023; A63B 21/16; A63B 21/4033; A63B 21/4034; A63B 22/16; A63B 22/18; A63B 26/003; A63B 69/18; A63B 69/0093; A63B 69/187; A63B 2071/0694;
(Continued)

(56) References Cited

U.S. PATENT DOCUMENTS 651,677 A 6/1900 Stroud
2,724,842 A * 11/1955 Rogovy ..... A47C 27/061 5/248

(Continued)

OTHER PUBLICATIONS

"Non Final Office Action" issued in parent U.S. Appl. No. 13/932,628, dated Nov. 3, 2014.

*Primary Examiner* — Loan H Thanh
*Assistant Examiner* — Megan Anderson
(74) *Attorney, Agent, or Firm* — Kaplan Breyer Schwarz, LLP

(57) ABSTRACT

A device for training purposes or recreational activities using structures having a range of properties. The training device may include a board made of wood (or other material such as metal, rubber, plastic, or a combination thereof) and one or more suspension assemblies coupled to the bottom surface of the board. The assembly is adapted to be coupled to a longitudinal or a lateral slot on the board. The slots allow a user to longitudinally and laterally move the assembly without uncoupling it from the board, thereby allowing the user to easily position and re-position the assembly on the board to change the performance of the training device. Each of the assemblies may include an inflatable base having a polygon or circular shape. The base is for providing a cushioning effect when the board impacts the ground after a user performs an aerial maneuver.

20 Claims, 21 Drawing Sheets

Related U.S. Application Data

(60) Provisional application No. 61/666,107, filed on Jun. 29, 2012.

(51) Int. Cl.

| | |
|---|---|
| ***A63B 22/16*** | (2006.01) |
| ***A63B 21/00*** | (2006.01) |
| ***A63B 26/00*** | (2006.01) |
| ***A63B 69/00*** | (2006.01) |
| ***A63B 21/02*** | (2006.01) |
| ***A63B 69/18*** | (2006.01) |
| ***A63B 21/068*** | (2006.01) |
| ***A63B 22/18*** | (2006.01) |
| *A63B 21/16* | (2006.01) |
| *A63B 71/06* | (2006.01) |

(52) U.S. Cl.
CPC ..... *A63B 21/4033* (2015.10); *A63B 22/18* (2013.01); *A63B 26/003* (2013.01); *A63B 69/0093* (2013.01); *A63B 69/18* (2013.01); *A63B 21/16* (2013.01); *A63B 21/4034* (2015.10); *A63B 69/187* (2013.01); *A63B 2071/0063* (2013.01); *A63B 2071/0694* (2013.01); *A63B 2207/02* (2013.01); *A63B 2209/00* (2013.01); *A63B 2220/40* (2013.01); *A63B 2220/803* (2013.01); *A63B 2225/62* (2013.01)

(58) Field of Classification Search
CPC ..... A63B 2071/0063; A63B 2225/62; A63B 2220/40; A63B 2207/02; A63B 2209/00; A63B 2220/803
USPC ..... 146/146, 51, 56
See application file for complete search history.

(56) References Cited

U.S. PATENT DOCUMENTS

| | | | | |
|---|---|---|---|---|
| 3,235,282 | A | 2/1965 | Bostick | |
| 4,660,299 | A * | 4/1987 | Omilusik | A43B 13/182 36/27 |
| 4,824,101 | A | 4/1989 | Karlas | |
| 4,856,776 | A * | 8/1989 | Ching-Liang | A63B 21/045 482/122 |
| 5,080,382 | A * | 1/1992 | Franz | A63C 17/01 280/1.182 |
| 5,752,329 | A * | 5/1998 | Horibata | A61L 2/035 36/141 |
| 5,795,277 | A * | 8/1998 | Bruntmyer | A63B 21/0004 280/87.041 |
| 5,897,474 | A | 4/1999 | Romero | |
| 6,398,395 | B1 * | 6/2002 | Hyun | A63C 17/26 362/192 |
| 6,408,514 | B1 * | 6/2002 | Mossbeck | B21F 33/04 140/3 CA |
| 6,811,523 | B1 * | 11/2004 | Timmer | A63B 21/0004 482/146 |
| 6,832,979 | B1 | 12/2004 | Yarbrough | |
| 7,070,192 | B1 | 7/2006 | Steiner | |
| 7,070,193 | B2 | 7/2006 | Yamaguchi | |
| 7,192,039 | B1 | 3/2007 | Snedaker | |
| 7,500,324 | B1 | 3/2009 | Power et al. | |
| 7,632,218 | B2 | 12/2009 | Sannes et al. | |
| 7,806,807 | B2 * | 10/2010 | Genua | A63B 21/0004 482/146 |
| 7,980,573 | B1 | 7/2011 | Naman | |
| 8,579,672 | B2 * | 11/2013 | Beutler | A63G 21/00 362/161 |
| 8,936,263 | B2 | 1/2015 | Rawlins | |
| 2002/0083616 | A1 * | 7/2002 | Hajianpour | A43B 13/182 36/7.8 |
| 2010/0140885 | A1 | 6/2010 | Corrente | |
| 2010/0225148 | A1 * | 9/2010 | Segato | B62J 1/00 297/195.1 |
| 2011/0221150 | A1 | 9/2011 | Harris | |
| 2013/0178346 | A1 | 7/2013 | Lin | |

* cited by examiner

EXERCISE DEVICE AND METHOD OF USING SAME

CROSS-REFERENCE TO RELATED APPLICATIONS

This application is a Continuation-in-Part of U.S. Non-Provisional application Ser. No. 13/932,628, filed on Jul. 1, 2013, which in turn claims the benefit of U.S. Provisional Application No. 61/666,107, filed on Jun. 29, 2012, each of which is incorporated herein by reference in their entirety.

BACKGROUND OF THE INVENTION

Various devices have been used as training aides by people for training various muscle groups. Such devices may be expensive and cumbersome, and thereby require users to drive to a gym or other established facility to use the various devices. Accordingly, there is a need in the art for an improved system and method for training for balance, posture, among other athletic attributes.

SUMMARY OF THE INVENTION

According to one aspect, the invention is directed to a rectangular board with spherically shaped balls affixed thereto. A rectangular training board may provide multiple planes of motion, thereby providing challenging training for a person using the training board. The apparatus will help facilitate balance, proprioceptive training, postural reactions, coordinated muscle response, muscle strengthening, quickens reflex time and helps improve athletic ability and performance.

Other aspects, features, advantages, etc. will become apparent to one skilled in the art when the description of the preferred embodiments of the invention herein is taken in conjunction with the accompanying drawings.

BRIEF DESCRIPTION OF THE DRAWINGS

For the purposes of illustrating the various aspects of the invention, there are shown in the drawings forms that are presently preferred, it being understood, however, that the invention is not limited to the precise arrangements and instrumentalities shown.

DETAILED DESCRIPTION

Figure 1A:
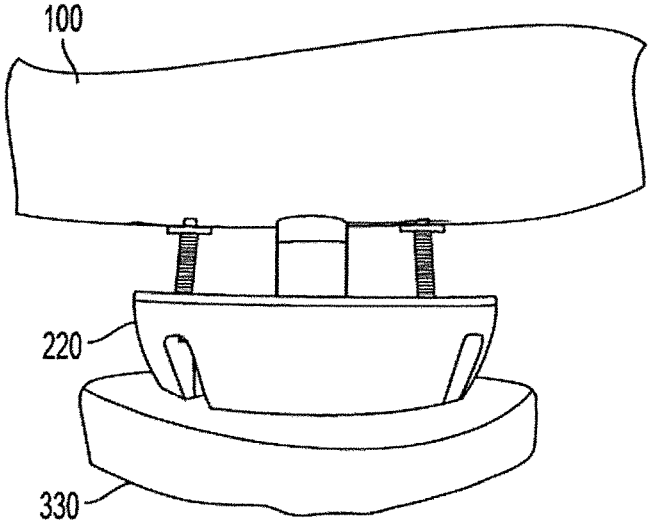
FIG. 1A is a frontal view of a portion of a training device in accordance with an embodiment of the present invention.

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to phrases such as "one embodiment" or "an embodiment" means that a particular feature, structure or characteristic described in connection with the embodiment is included in at least one embodiment of the invention. The appearances of phrases such as "in one embodiment" or "in an embodiment" in various places in the specification do not necessarily all refer to the same embodiment.

The training board disclosed herein may be an unstable, sensory stimulating rectangular "skate-board-shape" board, which may be used as a rocking board, or as a wobble board or fitness device.

The stator 20 (which may include all parts in the training device 10 other than the board 100, anchor assembly 110 and stabilizers screws 122, 124 and stabilizer holes 126, 128) may be made of the following materials: wood, metal, plastic and/or rubber. Moreover, any synthetic material may be included in the composition of the stator. Basically, the stator can be made of any material that is rigid or pliable. The board can also be made of any rigid or pliable material including wood or plastic. The stator 20 may include suspension linkage 200 and base 300.

A training board assembly 10 (also referred to as training device 10) according to an embodiment of the invention may include a rectangular board similar in shape and size to a skate board, and may be made of wood, metal, plastic, rubber, high density polyethylene filled with structural urethane or any natural or synthetic materials. Alternatively, the training board may be made of a combination of one or more of the above-listed materials. The training board assembly 10 preferably has one or more deformable or non-deformable structures affixed to a bottom surface thereof, to enable the training board to rotate about one or more axes (up to three axes in some embodiments) when a user is using the training board assembly. In this way, the training board assembly disclosed can emulate the operation of a skateboard or surfboard by responding to and partially resisting the forces imparted to the board by a user.

A training board assembly 10 according to the present invention may be made available with various widths and lengths of the boards themselves and with varying dimensions of the deformable bodies/structures (which may, but need not, be spherical) that may be affixed to the boards. The deformable bodies (also referred to herein as deformable members or "stators") located at the bottom of the training board may be permanently attached to the bottom surface of the board, or may instead be removeably attached to the boards, thereby enabling a single board to be used with a range of different deformable bodies (or stators) having different operational characteristics.

The deformable structures may be made of wood, plastic, rubber or any natural or synthetic material, or any combination of one or more of the above-mentioned materials and may be spherical, cylindrical or disk shaped.

One embodiment of training device 10 may include inserts for attaching interchangeable balls or stators (which may be spherical) to bottoms of the rectangular boards. The balls or stators may have a range of sizes and shapes. The inserts may be made of various materials including but not limited to: metal, plastic or any synthetic material. The insert may be employed along with a surface that can serve as a mount to which the deformable bodies, balls (which may be spherical), or stators can be attached. Springs having a wide range of compression coefficients may be used within the stators 20. For example, the springs may spring constants from 5 pounds per inch on up to 400 pounds per inch or higher if needed.

One embodiment of the training board assembly may include mounts made of metal, wood, plastic, rubber, or any synthetic material may be used to attach the multi-sized balls/spheres to the boards. (Herein, the term "stator" may be used to refer to an entirety of a training board other than the board itself and anchor(s) and stabilizer(s), if present on the training board). One embodiment may include the use of a slip-resistant, textured top surface which may be deployed to prevent foot shifting or slippage. In an embodiment, the deformable bodies may include embedded compression-loaded springs or coils. Indicia of trademark or branding and/or art work may be applied to the tops and bottoms of the rectangular boards. In an embodiment, training device 10 may have compression loaded coil springs embedded into the stators 20.

Various Applications:

A training device 10 according to an embodiment of the present invention may be used either for training or as a sport/recreational activity in itself. The board may be used to improve balance through proprioceptive training, postural reactions, and/or coordinated muscle response. The board may be used to strengthen and condition athletes through muscle response. The board may be used to quicken reflex time and to help improve athletic ability and performance.

A training device according to an embodiment of the present invention may be used as a training tool for skateboarding, waterboarding, or snowboarding as a therapeutic tool for conditioning or reconditioning the neural/muscular/skeletal body system; as an improved strength and conditioning tool, as in improved balance tool, and/or as sport activity equipment (in competitive and/or recreational sports).

A training device 10 according to an embodiment of the present invention may be used as sports equipment that emulates skateboard, waterboard, or snowboard functionality and performance. Further, use of embodiments of the invention discussed herein may improve the safety of the use of skateboards, wakeboards, snowboards. This improved safety may arise from the use of compliant material for a "shoe" 330 which is effective for emulating the operational characteristics of a real skateboard in a stationary position on the ground, and to thereby effectively train the user in the safe operation of a skateboard while the user is an a safe and controlled environment.

An embodiment of the training device 10 disclosed herein may enable a user to emulate the movements, muscle training, coordination, and timing factors present in conventional skateboarding, but in a safer manner. Specifically, while the training device may be mobile rotationally about one, two, or three axes, and may vertically with respect to the ground or other support surface, there is no significant forward motion. Thus, the risk of collision with vehicles on the street, or with people, is absent. Moreover, the risk of injury upon falling off the board can be minimized by selecting soft, safe surfaces about the periphery of the board to minimize the impact arising from a user falling off the training board. Thus, a training board according an embodiment of the present invention can enable a user to rival and possibly surpass the training value of a mobile skateboard while using a mostly stationary board.

A board according to an embodiment of the present invention may operate as a therapeutic tool that can function as a wobble or roller board. The board may incorporate springs, and/or stationary or rotating balls. The board may include stationary substantially spherical deformable bodies that can be inflated to adjust the bounce and/or tension desired by the user of the training board. The board according to an embodiment of the present invention may include rotating balls (or, rotating stators) that can rotate in one or many planes relative to the board.

In one embodiment, stabilizers extending from the board to a top ring of the stator may operate to control any of the roll, pitch, and/or yaw of the board 100 with respect to the stator 20. In one embodiment, the stabilizers could control the roll (rotation of the board about the longitudinal axis of the training device) and yaw of the board with respect to the stator, but allow the pitch angle (i.e. the forward-backward tilt of the board 100 with respect to the base 300) to vary. In another embodiment, the yaw and pitch angles of the board with respect to the stator could be controlled, while the roll angle could be controlled. In another embodiment, the yaw angle between the board and the stator could be controlled, but the board could be permitted to rotate along the roll and pitch angles with respect to the stator of the training device.

Training Board Features:

A training board according to an embodiment of the present invention may include one or more of the following features.

(1) Spherical, cylindrical or disk shaped balls may be attached to a rectangular board for the purpose of creating an apparatus that could be used for therapeutic, conditioning, strengthening, training or sport activities in a safe manner.

(2) Deformable or non-deformable structures (which may be substantially spherical, cylindrical or disk shaped) may be permanently attached to a flat wooden board, or can be removeably attached to a board so that different deformable structures may be attached to the same board.

3) A training board may be assembled such that the deformable structures (which may be spherical, cylindrical or disk shaped) are static (i.e. stationary). However, alternatively the deformable non-deformable structures may be coupled to the board such that the structures are able to rotate about one or more axes with respect to the board, and/or move linearly with respect to the board.

4) A board according to an embodiment of the present invention may include deformable or non-deformable structures that can be attached to the board using respective interposers between the structures and the board which provide spring function, thereby allowing a user to make the apparatus bounce, upon applying a sufficient amount of force thereto.

5) In an embodiment, the deformable or non-deformable structures may include a spring function, thereby allowing the user to make the apparatus bounce, when the user applies force thereto.

6) In an embodiment, the deformable or non-deformable structures and/or or interposer(s) may include weights for the purpose of balancing the training board while the board is being used by the user. In an embodiment, the magnitudes of the weights, and the positions of the weights along the width and length dimensions of the board may be made adjustable to compensate for (a) irregularities of the board itself; (b) the conditions in which the board is being used (such as when the board is used on a slanted surface); (c) the characteristics of the user (height, weight etc.); and/or (d) the way in which the training board will be used.

7) In an embodiment, the training board may emulate a skate board in function and performance in a stationary position without the use of wheels, or other motion-enabling support elements.

8) In an embodiment, the training board may emulate a water board in function and performance.

9) In an embodiment, the training board may emulate a snow board in function and performance.

10) Stationary or Rotating Balls can be inflated to adjust the bounce & or tension.

11) Rotating balls can rotate in one or many planes relative to the board.

12) The balls that are attachable to the board can be deformable or non-deformable.

13) An embodiment may include the use of clips to secure that can secure a user's feet to the board.

14) An embodiment may include the use of roll limiters to define a range of motion in an axial plane (i.e. roll) and the balance of skateboard. Thus, the roll limiters may prevent the board from rotating beyond a pre-determined degree of angular rotation along the roll axis.

15) An embodiment may include spherical, cylindrical or disk shaped structures which may contain weights for providing balance. Alternatively or additionally, the structures of different shapes may include springs.

16) In an embodiment, the spring cavity, guideway, plunger and lower ring may act together to hold the spring in place throughout its entire range of motion.

17) Stabilizers may be provided which may be operable to control the roll and yaw of board with respect to the stator.

18) A compliant layer, referred to herein as a "shoe" may be placed between the stator (which may include deformable members) and the ground to provide stability and cushioning for the training apparatus.

One purpose of embodiments of the training device disclosed herein is to provide a safe method to train for sports that require a board such as skateboarding, snowboarding, wakeboarding and/or surfing. It also can be used as a therapeutic tool for proprioceptive training, postural reactions, coordinated muscle response and muscle strengthening.

The operation of the training device is preferably able to simulate the operational characteristics of boards used in athletic sports such as skateboarding, snowboarding, wakeboarding or surfing by placing springs between the base of training device and the board on which the user stands that compress in response to forces applied thereto by the user and which produce upward thrust as the springs extend again. Once the internal springs decompress, the board can be thrust into the air allowing the operator of the training device to perform aerial maneuvers and simulating tricks and stunts commonly practiced in the aforementioned board-related sports.

For example, a skateboarder could perform common tricks such as an "Ollie" or "kickflip" more safely when using a training device in accordance with an embodiment of the present invention than when using a real skateboard with wheels. The characteristics of the internal springs can be selected so as to produce a range of thrust force levels, ranging from a few pounds to more than four hundred pounds.

Figure 1B:
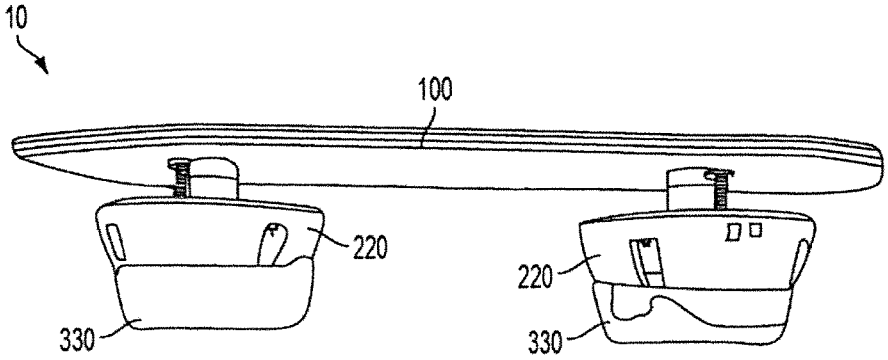
FIG. 1B is a side view of the training device of FIG. 1A.
Figure 1C:
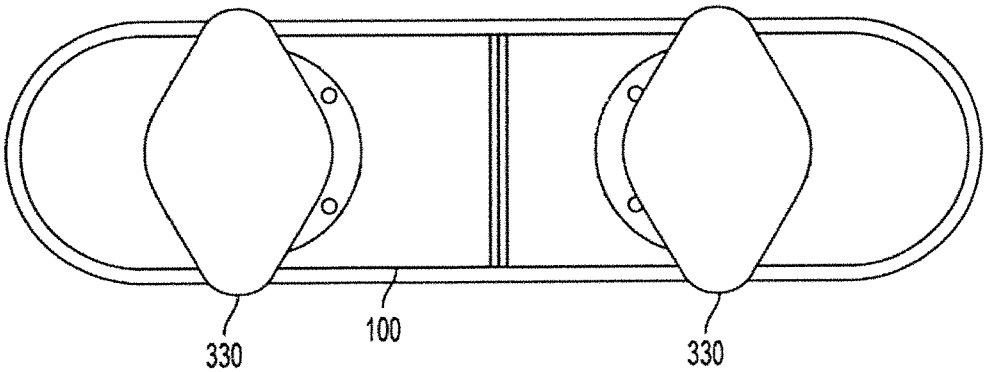
FIG. 1C is a bottom view of the training device of FIG. 1A in which the longitudinal axis of the training device and of the board extends from left to right, the lateral axis extends from top to bottom, and the vertical axis extends into and out of the page, in the view of FIG. 1C.

FIG. 1A is a frontal view of a portion of a training device 10 in accordance with an embodiment of the present invention. FIG. 1B is a side view of the training device 10 of FIG. 1A. FIG. 1C is a bottom view of the training device 10 of FIG. 1B.

The training device 10 of FIG. 1A may include board 100, spring ball 220, and shoe 330, which shoe may be made of polyurethane or other suitable rubber, or other suitably compliant material.

Figure 2:
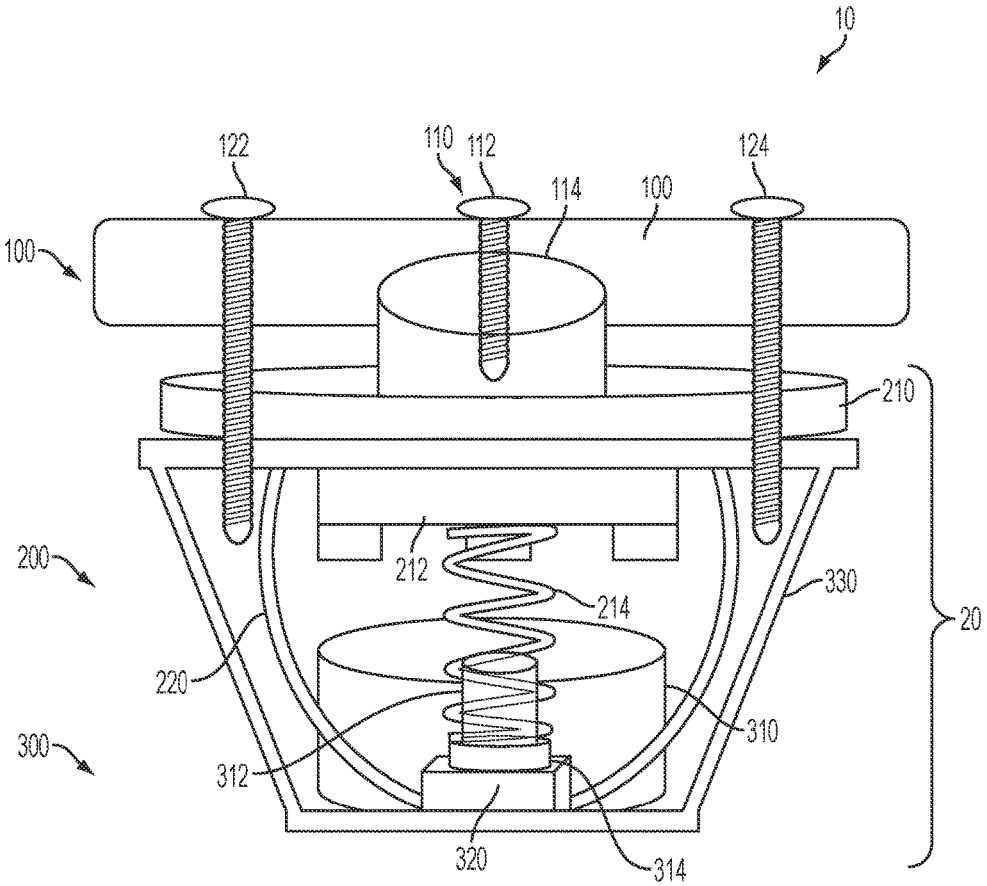
FIG. 2 is an elevational view of a portion of a training device having a board coupled to a stator in accordance with an embodiment of the present invention.

FIG. 2 is an elevational view of a portion of a training device 10 having a board 100 coupled to a stator 20 in accordance with an embodiment of the present invention. Training device 10 of FIG. 2 may include board 100, suspension linkage 200 (also referred to as a suspension linkage assembly), and base 300. Stator 20 may include suspension linkage 200 and base 300.

Board 100 may include anchor 110, anchor screw 112, anchor shaft 114, stabilizer screws 122, 124 and corresponding stabilizer holes 126 and 128. Suspension linkage 200 may include top ring 210, plunger 212, spring 214, and spring ball 220. Base 300 may include spring cavity 310, spring guideway 312, bottom ring 314, pedestal 220, and shoe 330. Herein, the combination of the stabilizer screws and stabilizer holes may be referred to as a stabilizer assembly.

Figure 3:
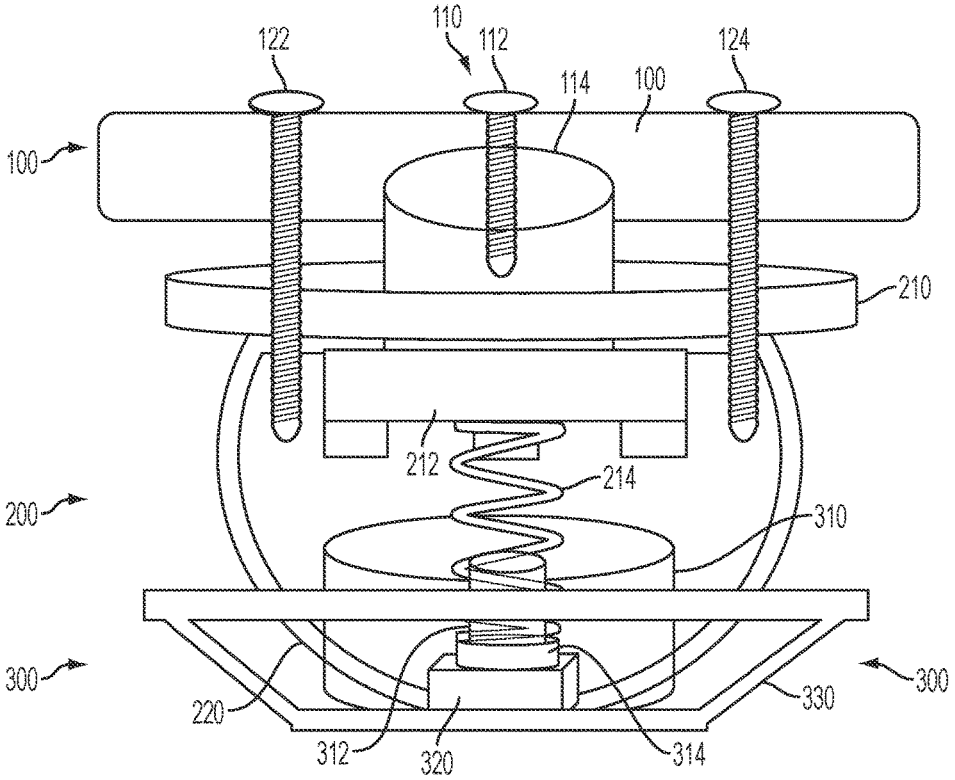
FIG. 3 is an elevational view of the training device of FIG. 2 having a different sized shoe attached thereto than the training device embodiment shown in FIG. 2.

FIG. 3 is an elevational view of the training device 10 of FIG. 2 having a different sized shoe 330 attached. For the sake of brevity, the discussion of parts shown in FIG. 3 that are unchanged with respect to those shown in FIG. 2 is not repeated in this section. In the embodiment of FIG. 3, it may be seen that shoe 330 has a reduced vertical profile, rising to a vertical level just below the upper edge of the spring cavity 310.

Figure 4:
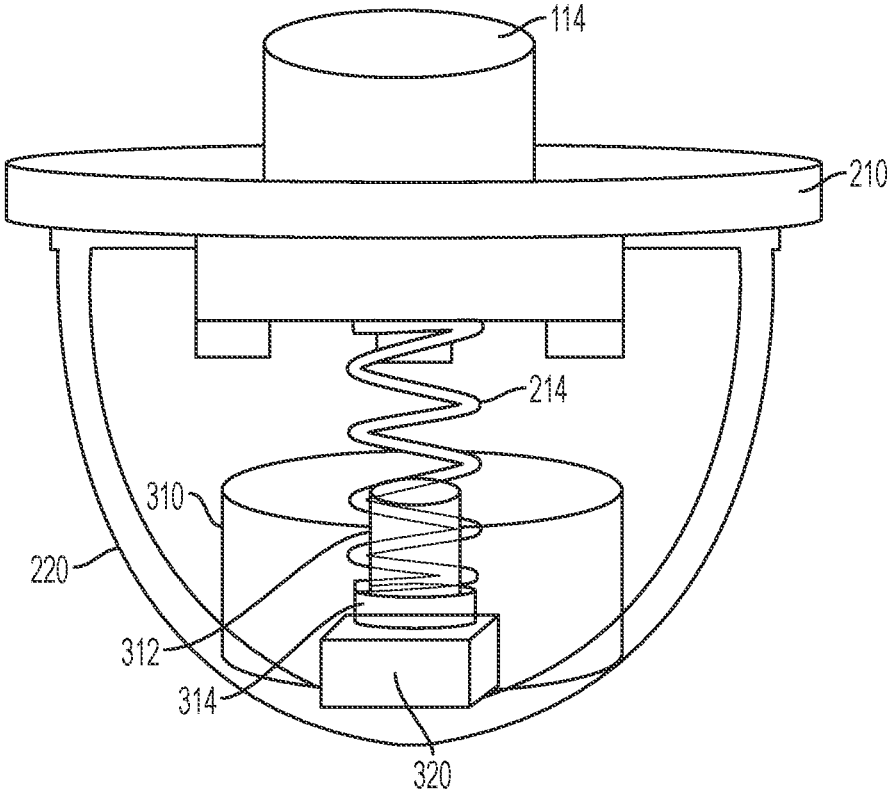
FIG. 4 is an elevational view of a portion of the stator of the training device of FIG. 2.

FIG. 4 is an elevational view of a portion of the stator 20 of the training device 10 of FIG. 2. FIG. 4 shows the spring 214 and spring guideway 312 in greater detail. In this embodiment, as upper ring 210 is forced downward against the force of spring 214, the coils of spring 214 will wrap around spring guideway 312, and the outer diameter of spring 214 will be located well within the interior of spring cavity 310.

Figure 5:
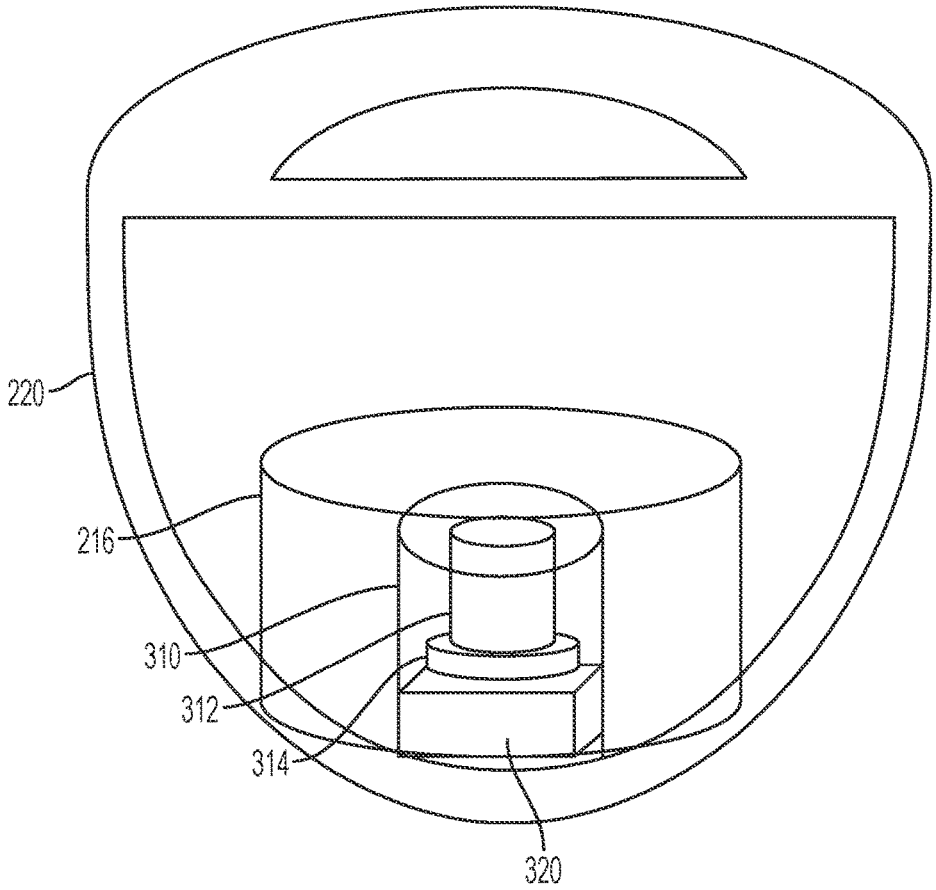
FIG. 5 is an elevational view of a portion of the stator of the training device of FIG. 2.

FIG. 5 is an elevational view of a portion of the stator 20 of the training device of FIG. 2. FIG. 5 shows spring ball 220, plunger cavity 216, spring cavity 310, spring guideway 312 and bottom ring 314.

Figure 6:
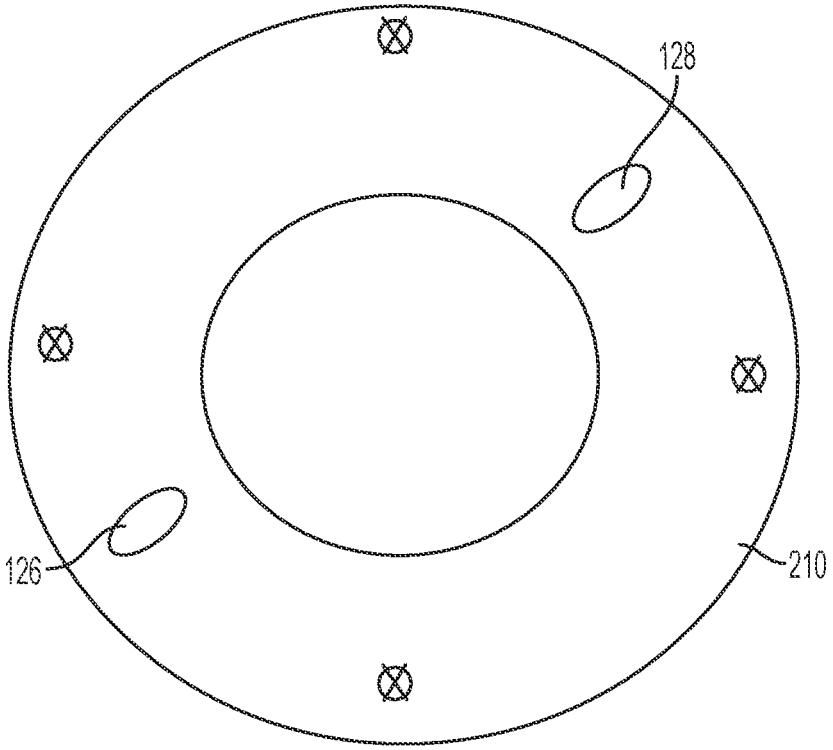
FIG. 6 is a plan view of a top ring portion of a suspension linkage structure of the embodiment shown in FIG. 2.
Figure 7A:
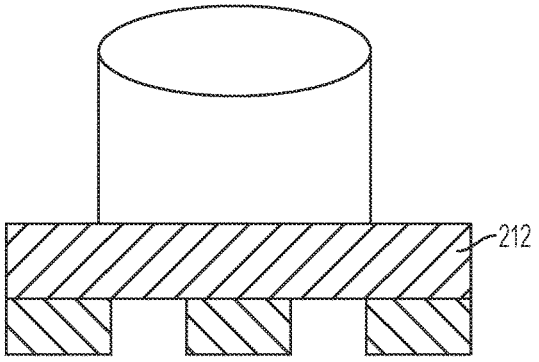
FIG. 7A is an elevational view of the plunger included in the training device of FIG. 2.
Figure 7B:
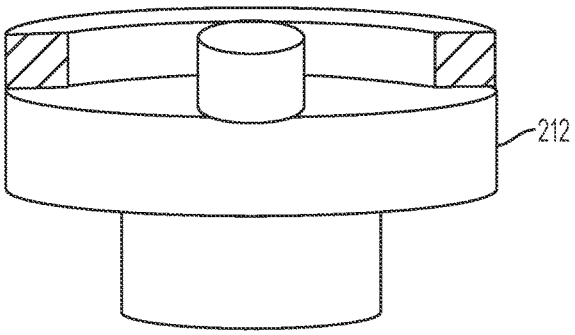
FIG. 7B is partially elevational and partially sectional view of the plunger of FIG. 7A.
Figure 7C:
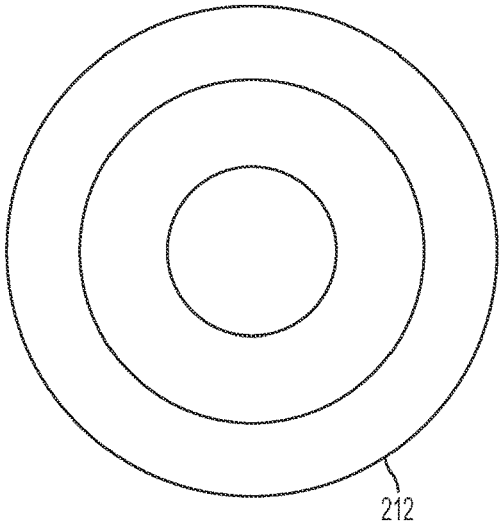
FIG. 7C is a top view of the plunger of FIG. 7A.

FIG. 6 provides a detailed view of top ring 210 and of holes 126, 128 through which stabilizer bars may be inserted.

The internal mechanisms of the stator which include the metal plunger, top and bottom rings & polyurethane shoe, may provide a safe and reliable method for thrusting the board into the air as the operator performs maneuvers. The design and construction, combined with the type of material selected for the stator, anchor and stabilizers preferably produce a rugged apparatus that can withstand the pounding of the apparatus on any surface the operator chooses to train on in surface streets or parks. The anchor and stabilizers may be made out of aluminum and/or steel. The various stator components may include metals, plastics, and/or rubber.

A more detailed description of the training device 10 follows. In one embodiment, two stators may be rigidly attached to the board 100 (such as, via the anchor), and the internal mechanisms of the stator 20 allow the springs to be independently compressed based on the location and the amount of force that gets applied to the board. The shoes 330 and stabilizers preferably provide cushioning and stability.

The shoes 330 may serve multiple purposes. The shoes 330 may absorb some of the force (by deforming) of impact when the training device 10 strikes a ground surface after the device 10 has been thrust in the air, thereby providing cushioning. The shoes 330 may also limit the amount of pitch and roll the training device 10 will experience when an operator is on top of the board and the training device is making contact with a ground surface, thereby providing stability. The stabilizers limit the amount of yaw the training device 10 will experience while the operator is on top of the board and the apparatus is making contact with a ground surface. The stabilizers preferably provide stability by preventing the shoes 330 from rotating relative to the board.

The shape of the shoes may help determine the amount of pitch and roll the training device 10 will experience with an operator on top of the board while the training device 10 is making contact with a ground surface. The thickness of the shoes 300 may determine how much impact can be absorbed by the shoes 330, which absorption provides cushioning and prevents the stator from being damaged.

Figure 8:
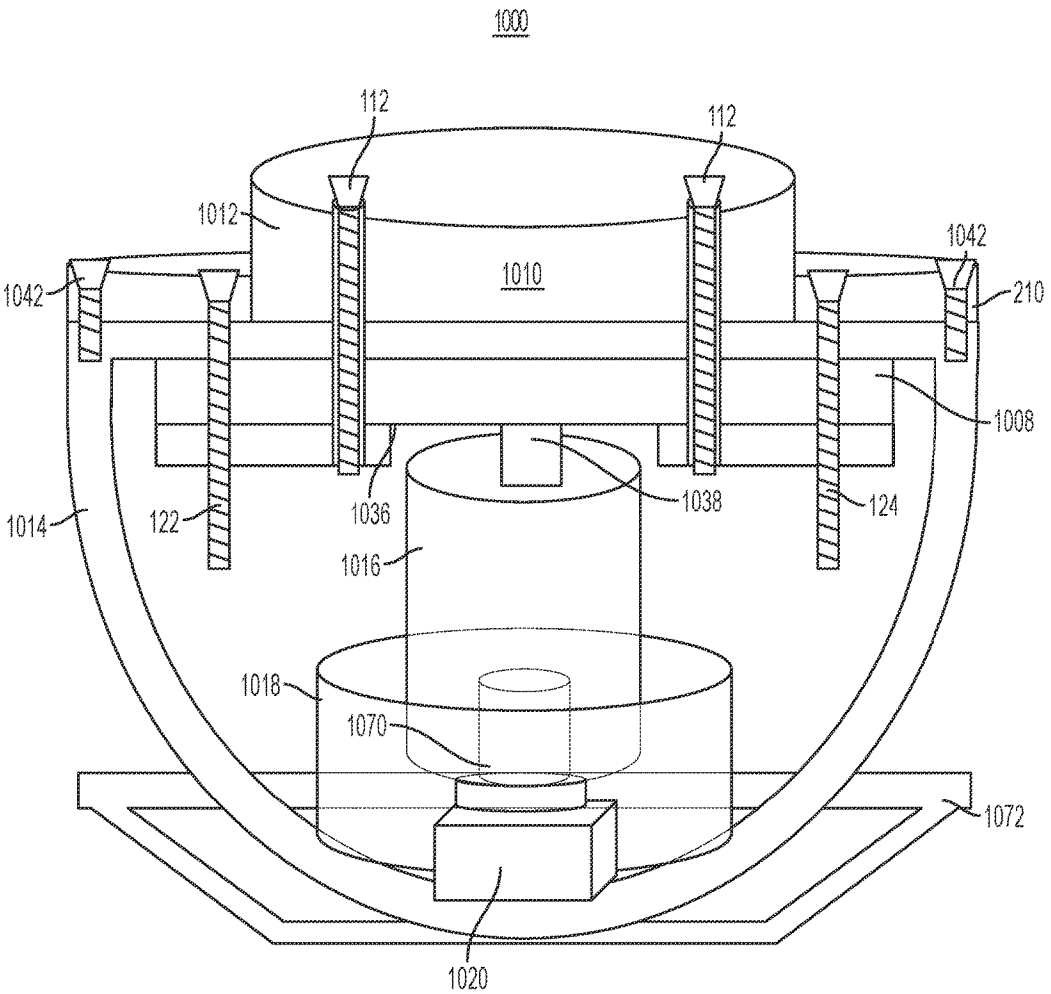
FIG. 8 shows a cross-sectional view of a suspension assembly in accordance with an illustrative embodiment of the present invention.

FIG. 8 depicts an alternative embodiment of the suspension assemblies (i.e., stator 20) discussed in this disclosure thus far. In the suspension assembly discussed above, with respect to FIG. 2, for example, stabilizer screws 122 and 124 are threaded through board 100, top ring 210, and into the interior of shoe 330. This configuration depicted in FIG. 2 is to prevent top ring 210 and shoe 330 from rotating around plunger 212. In the alternative embodiment depicted in FIG. 8, the same result can be achieved by threading stabilizer screws 122 and 124 through top ring 210 and into the lower portion 1008 of plunger 1010. In other words, the stabilizer screws in the embodiment shown in FIG. 8 are no longer threaded through board 100. The advantage of this configuration is that it reduces the number of screws a user must unscrew to uncouple the suspension assembly from board 100. The stabilizer screws 122 and 124 in the embodiment shown in FIG. 8 also controls the roll and rotation of deformable member 1014 with respect to board 100. It will also be clear to those skilled in the art that stabilizer screws 122 and 124 may operate to control one or more of the roll, pitch, and yaw of the board 100. For example, the stabilizers could control the roll (rotation of the board about the longitudinal axis of the training device) and yaw of the board with respect to the stator, but allow the pitch angle (i.e. the forward-backward tilt of the board 100 with respect to the base 1072) to vary. In a further example, the yaw and pitch angles of board 100 with respect to the stator could be controlled, while the roll angle could be controlled. In yet another example, the yaw angle between board 100 and the stator could be controlled, but the board could be permitted to rotate along the roll and pitch angles with respect to the stator of the training device.

In the embodiment shown in FIG. 8, it is preferable for stabilizer screws 122 and 124 to be adapted to limit rotation of board 100, with respect to a base or ground, about a yaw axis of the training device. In another preferred embodiment, stabilizer screws 122 and 124 are adapted to allow board 100 to rotate with respect to a base or ground along a pitch and a roll axes, but not along a yaw axis of the training device.

The elements depicted in FIG. 8 will now be discussed in more detail. FIG. 8 depicts a suspension assembly 1000 (i.e., a stator) that is adapted to be coupled to the bottom surface of board 100. Some of the major components of suspension assembly 1000 comprises: stabilizer screws 122 and 124, top ring 210, plunger 1010 having a lower portion 1008 and an upper portion 1012, deformable member 1014 (e.g., shoe 330), compressible member 1016 (e.g., spring 214), guideway 1018, pedestal 1020, and at least one anchor screw 112. It will be appreciated by those skilled in the art (after reading this disclosure) that the elements depicted in FIG. 8 can be the same as, or different from, the elements discussed above, with respect to FIGS. 1-7.

Figure 9A:
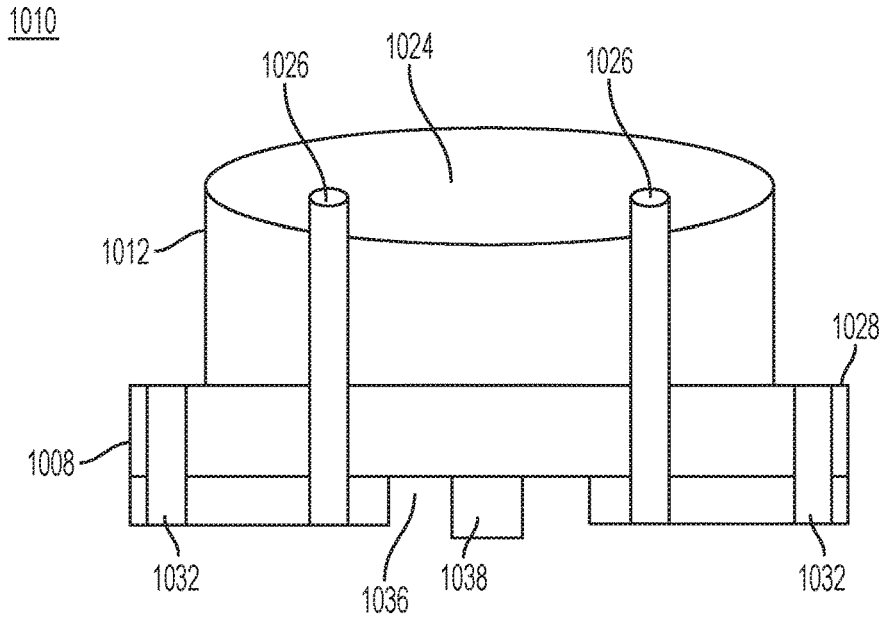
FIG. 9A shows a cross-sectional view of a plunger in accordance with an alternative embodiment of the present invention.
Figure 9B:
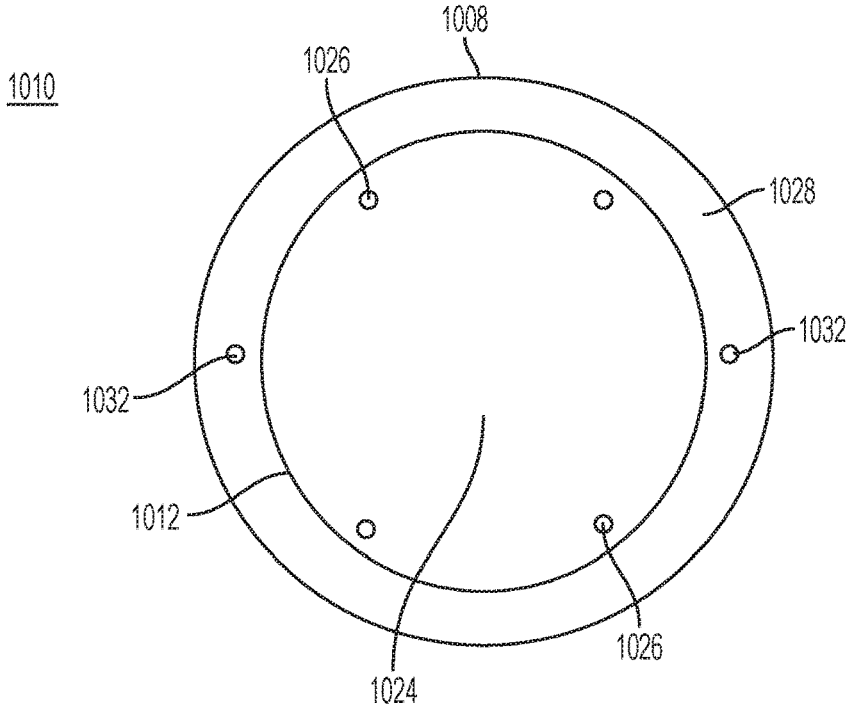
FIG. 9B shows a top view of the plunger of FIG. 9A.

The upper portion 1012 of plunger 1010 has an upper surface 1024, as shown in FIGS. 9A and 9B. Although four anchor holes 1026 are depicted in FIG. 9B, the preferred embodiment is to use only one anchor hole 1026. However, it will be clear to those skilled in the art, after reading this disclosure, how to make and use alternative embodiments of the invention in which one, two, three, etc., anchor holes 126 is/are used without departing from the scope of the present invention. Each of the anchor holes 1026 is adapted to receive the body of anchor screw 112 passing through board 100. The body of anchor screw 112 is threaded into anchor hole 1026 to couple plunger 1010 to the bottom surface of board 100. The upper portion 1012 has a circular or cylindrical shape and is constructed with a slightly smaller diameter than the diameter of the through-hole of top ring 210 shown in FIG. 6. The diameter difference allows upper portion 1012 of plunger 1010 to be received by the through-hole of top ring 210 and to allow upper portion 1012 to slide back and forth along the through-hole.

Plunger 1010 further includes a lower portion 1008 that is integrally formed with upper portion 1012—i.e., the plunger in constructed as a single, unitary piece having a lower and an upper portion. In other embodiments, lower portion 1008 is coupled to upper portion 1012 by a screw or glued together by an adhesive, such as epoxy. Like upper portion 1012, lower portion 1008 has a circular or cylindrical shape, but with a diameter that is greater than the diameter of upper portion 1012. The diameter difference between the upper and lower portions forms a shoulder 1028 having an upper surface that is adapted to contact (e.g., abut or presses-up against) an underside of top ring 210 or a lid that closes deformable member 1014.

More specifically, as downward force is applied to the upper surface of board 100 (e.g., when a user stands on board 100), the upper portion 1012 of plunger 1010 slides downward along the through-hole of top ring 210 and into the interior of deformable member 1014, thereby causing lower portion 1008 to compress compressible member 1016. When the downward force is removed from board 100 (e.g., when a user jumps off of board 100 to perform an aerial maneuver, such as a kick-flip), this causes compressible member 1016 to re-extend and deflect board 100 from the ground and into the air.

Continuing with the description of lower portion 1008, FIGS. 9A and 9B show two stabilizer holes 1032 extending through the lower portion of plunger 1010. The stabilizer holes 1032 are adapted to receive a corresponding stabilizer screw 122 and 124 for preventing top ring 210 and deformable member 1014 from rotating around upper portion 1012 of plunger 1010. The stabilizer screws 122 and 124 are also adapted to controls the roll and rotation of deformable member 1014 with respect to board 100. As shown in FIG. 6, top ring 210 also has at least two stabilizer holes 126. The stabilizer holes of top ring 210 are aligned with the stabilizer holes 1032 arranged on the lower portion 1008 of plunger 1010, so that a stabilizer screw 122 or 124 can be threaded through the top ring and the lower portion of plunger 1010, as shown in FIG. 8. Each of the stabilizer screws 122 and 124 is threaded until a portion of the stabilizer screw extends past an underside of lower portion 1008 and into the interior of deformable member 1014. FIG. 6 also shows top ring 210 arranged with at least four mounting holes, each of which is aligned with a corresponding mounting hole of deformable member 1014. Once aligned, a mounting screw 1042 is threaded through each of the aligned mounting holes to couple top ring 210 to deformable member 1014, as shown in FIG. 8. It should be noted that FIG. 8 only shows two of the mounting screws 1042 threaded through top ring 210 and deformable member 1014. It will be clear to those skilled in the art that the remaining two mounting screws 1042 are behind the ones depicted in FIG. 8.

FIG. 9A also shows lower portion 1008 having a guideway 1036 with a protrusion 1038 extending therefrom. The guideway 1036 is sized and shaped to receive one end of compressible member 1016, while protrusion 1038 is adapted to be received by the compressible member. This configuration is adapted to guide compressible member 1016 in a desired direction when it is being compressed and re-extended.

The compressible member 1016 will now be described in more detail, with reference to FIGS. 8 and 10A to 10D. One end of compressible member 1016 is seated within an upper guideway (i.e., guideway 1036 of plunger 1010) for guiding compressible member 1016 in a desired direction. Likewise, the other end of compressible member 1016 is seated within a lower guideway 1018 for guiding compressible member 1016 in a desired direction. The guideway 1018 similarly has a protrusion 1070 that is adapted to be received by the compressible member. Accordingly, compressible member 1016 is sandwiched between lower guideway 1018 and upper guideway 1036. As downward force is applied to the upper surface of board 100, upper portion 1012 of plunger 1010 slides downward along the through-hole of top ring 210. The downward movement of upper portion 1012 drives lower portion 1008 downwards to compress compressible member 1016 towards guideway 1018. When the user-applied downward force recedes, compressible member 1016 re-extends to deflect board 100 off from the ground.

Figure 10C:
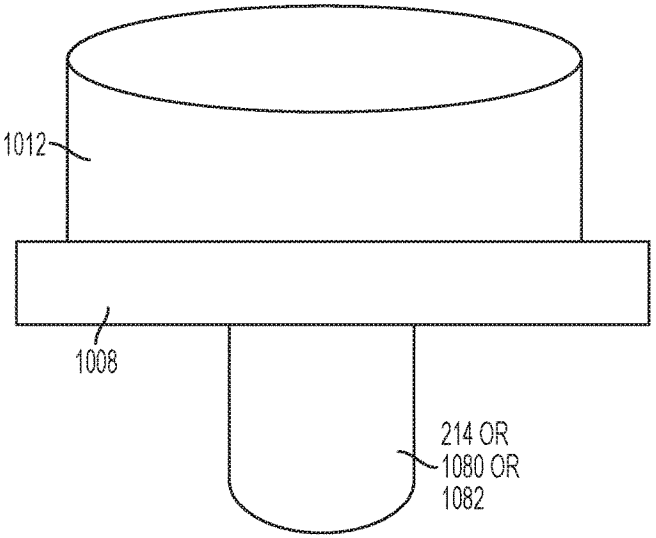
FIGS. 10A to 10E show a compressible member in accordance with an illustrative embodiment of the present invention.
Figure 10B:
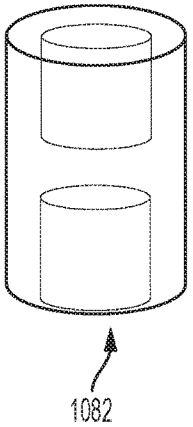
Figure 10A:
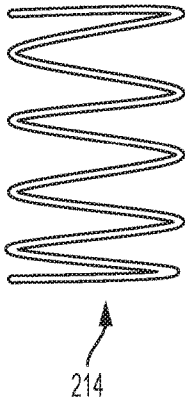
Figure 10E:
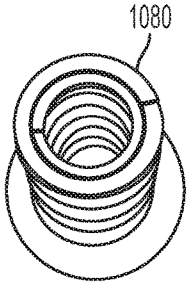
Figure 10D:
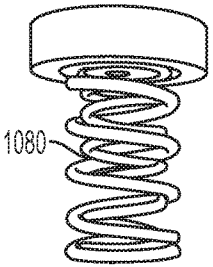

As discussed at the beginning of this disclosure, the compressible member can be, for example, and without limitation, a coil spring or a compression-loaded spring as shown in FIG. 10A. In alternative embodiments, the compressible member can be a nested coil spring 1080 (e.g., an automotive valve spring, etc.) as shown in FIGS. 10D and 10E, or a solid piece of compressible material 1082 having a Shore hardness of 60A to 90A (measured with a durometer Shore type-A scale) as shown in FIG. 10B. The solid piece of compressible material 1082 is resilient enough to radially deform in response to the downward force of plunger 1010 and to re-extend as that downward force is removed from the board 100. The solid piece of compressible material 1082 can be made from plastic, rubber, polyurethane, or a combination thereof. FIG. 10C shows a combination of plunger 1010 unitarily constructed with a coil spring 214, nested coil spring 1080, or the solid piece of compressible material 1082 discussed above. That is, the plunger and the compressible member are constructed as a single piece. The compressible member 1016 can be any one of the springs shown in FIGS. 10A to 10E without departing from the scope of the present invention.

Returning back to FIG. 8, deformable member 1014 is depicted as housing lower portion 1008, compressible member 1016, and lower guideway 1018, each of which form a structural relationship with one another to deflect board 100 off from the ground. In accordance with the illustrative embodiment, deformable member 1014 is made from rubber, plastic, polyurethane, or a combination thereof, and can be opaque (e.g., not transparent or translucent) or transparent (e.g., clear, translucent, etc.). In the embodiment in which deformable member 1014 is transparent, one or more sensors (e.g., accelerometers, gyroscopes, etc.) and light sources (e.g., light emitting diodes, etc.) are housed within deformable member 1014 so that light can be emitted from the interior to the exterior of the deformable member when a user performs an aerial maneuver with the training device, or when the training device impacts the ground. Continuing with the preferred embodiment, deformable member 1014 has a Shore hardness similar to that of a skateboard wheel, which is typically in the range of 75A to 95A. The deformable member is depicted as having a spherical shape, but it will be clear to those skilled in the art, after reading this disclosure, how to make and use alternative embodiments of the invention in which deformable member 1014 can have any desired shaped.

Figure 13A:
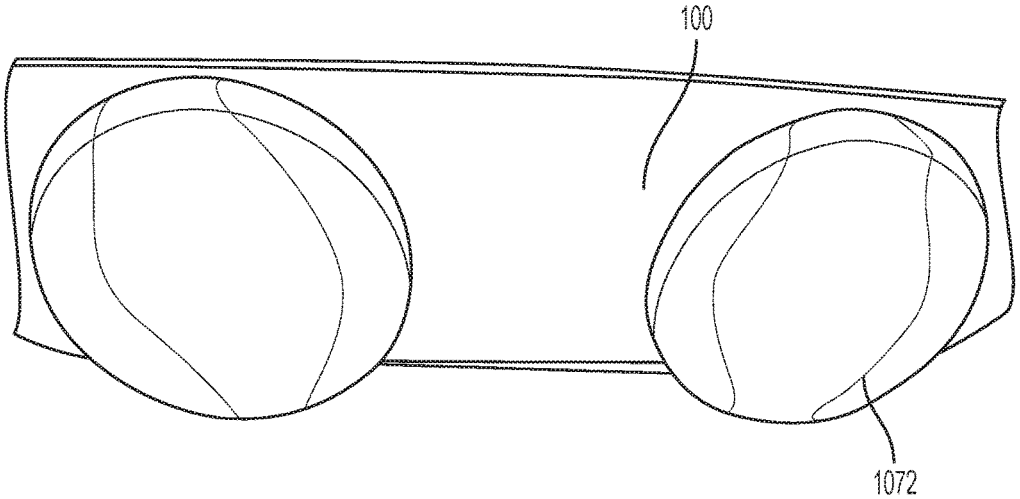
FIGS. 13A and 13B show a circular-shaped base coupled to the suspension assembly of FIG. 8.
Figure 13B:
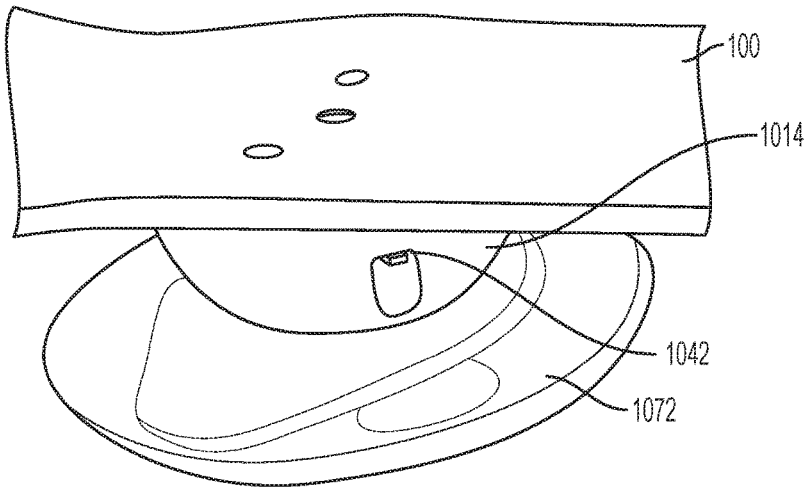
Figure 14B:
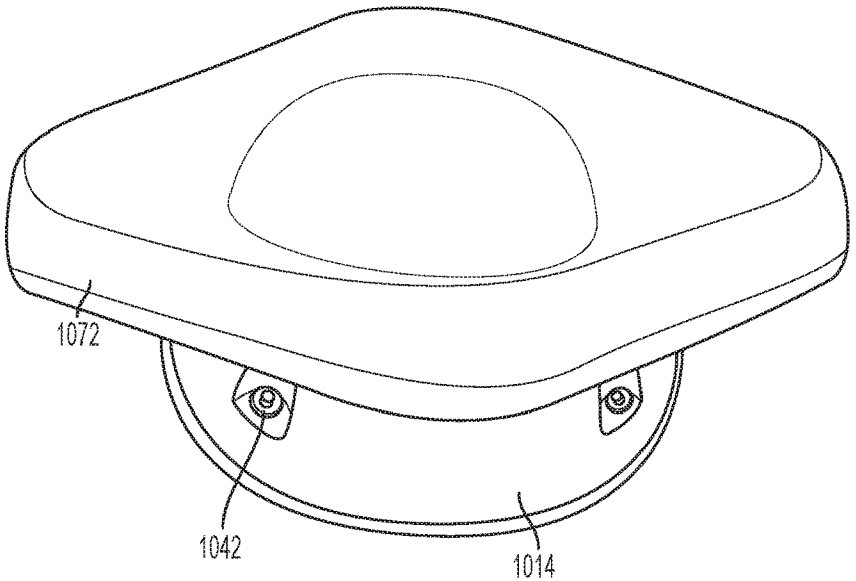
FIGS. 14A and 14B show a diamond-shaped base coupled to the suspension assembly of FIG. 8.
Figure 14A:
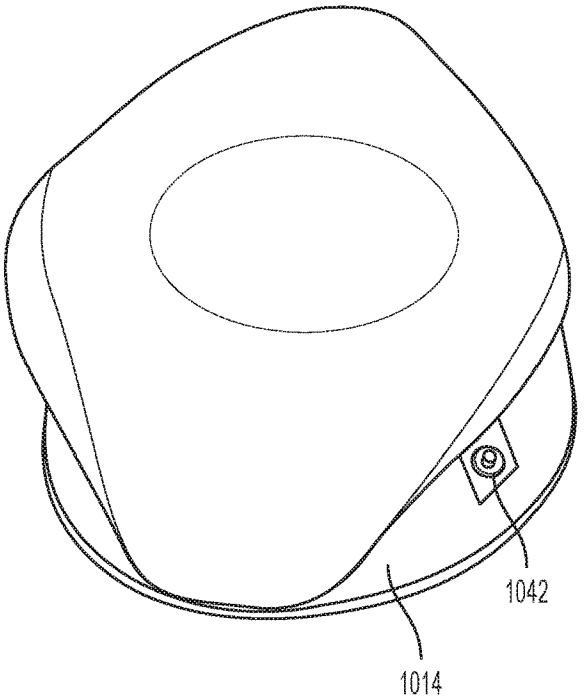

FIG. 8 also depicts a base 1072 coupled to the bottom portion of deformable member 1014. Base 1072 is made from plastic, rubber, polyurethane, or a combination thereof, and is adapted to provide a cushioning effect for board 100 upon impacting the ground (e.g., after performing an aerial maneuver). In some embodiments, base 1072 surrounds the entire exterior of deformable member 1014. In other embodiments, base 1072 only surrounds the medial and/or lower portions of deformable member 1014. The base 1072 can have any circular shape (e.g., oval, disc, etc., as shown in FIGS. 13A and 13B) or any polygon shape (e.g., diamond, square, rectangle, triangle, etc., as shown in FIGS. 14A and 14B). Additionally, base 1072 is adapted to include means for inflating and deflating the base to adjust the cushioning effect of the training device. The means for inflating and deflating the base can be similar to that of a tire for an automobile or a bicycle.

Figure 11A:
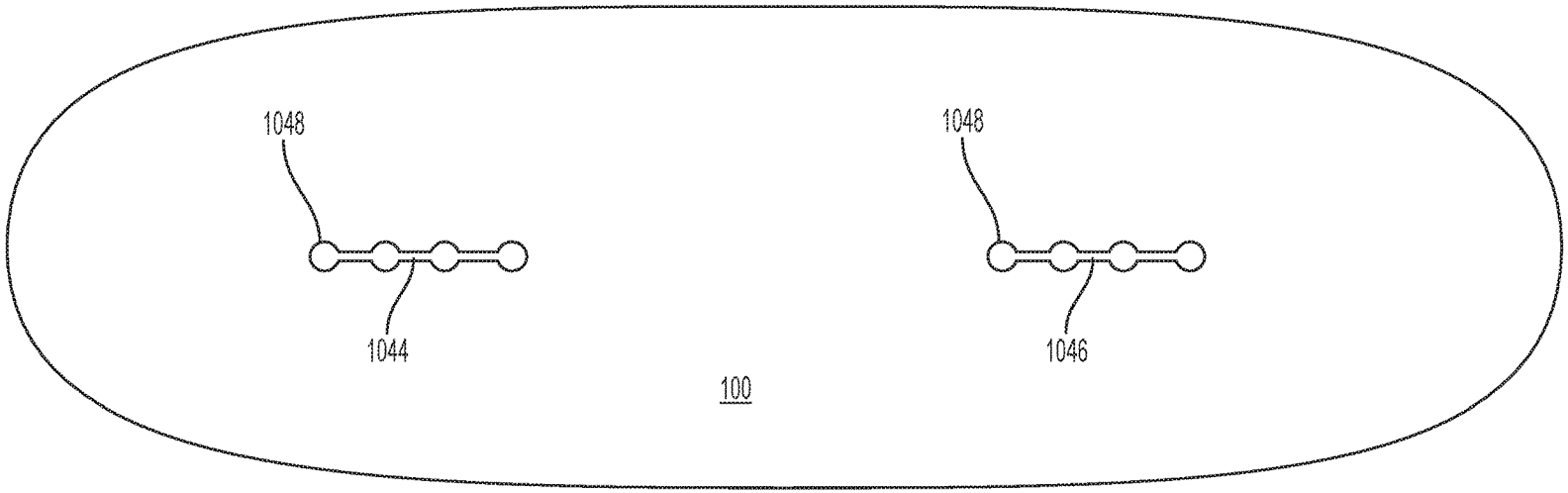
FIGS. 11A to 11E show a top view of a board having a plurality of slots for mounting one or more suspension assemblies to a bottom surface of the board.

Turning now to FIGS. 11A to 11E, board 100 provides means for a user to couple suspension assembly 1000 to a distal portion and a proximal portion of the board, and to allow the user to longitudinally move the coupled suspension assembly without uncoupling it from the board. As shown in FIG. 11A, the distal portion of board 100 is arranged with a longitudinal slot 1044. Likewise, the proximal portion of board 100 is arranged with a longitudinal slot 1046. Each of the slots 1044 and 1046 is arranged along a longitudinal axis of board 100.

As further shown in FIG. 11A, each slot 1044 and 1046 has a plurality of countersunk or counter-bore holes 1048 that extend through board 100. Each countersunk or counter-bore hole 1048 is adapted to receive an anchor screw 112 to be threaded into upper portion 1012 of plunger 1010 for coupling suspension assembly 1000 to the bottom surface of board 100.

Each of the countersunk or counter-bore holes 1048 of a respective longitudinal slot is connected to adjacent countersunk or counter-bore holes 1048 through a channel. This channel allows the body of anchor screw 112 to move freely along its respective longitudinal slot. Thus, for example, if a user desires to change the performance of the training device, the user can loosen anchor screw 112 (without completely unscrewing it from upper portion 1012 of plunger 1010) and move the suspension assembly 1000 along its respective longitudinally slot without uncoupling it from board 100.

Figure 11B:
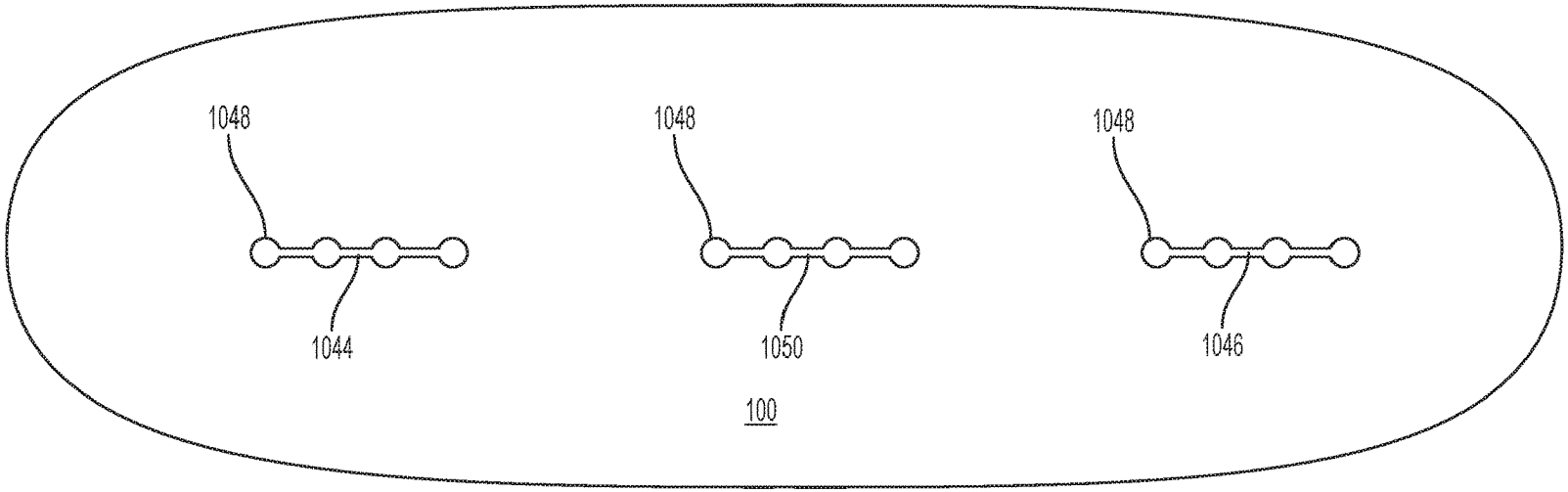

FIG. 11B shows an alternative embodiment of board 100. In this embodiment, board 100 has three longitudinal slots—namely, a first longitudinal slot 1044, a second longitudinal slot 1046, and a third longitudinal slot 1050. Each of the three longitudinal slots is the same as the ones described above, with respect to FIG. 11A. The only difference is that the medial portion of board 100 is now provided with a longitudinal slot 1050 to allow the possibility of coupling a third suspension assemblies to the medial portion of board 100, either alone or with the other two suspension assemblies.

Figure 11C:
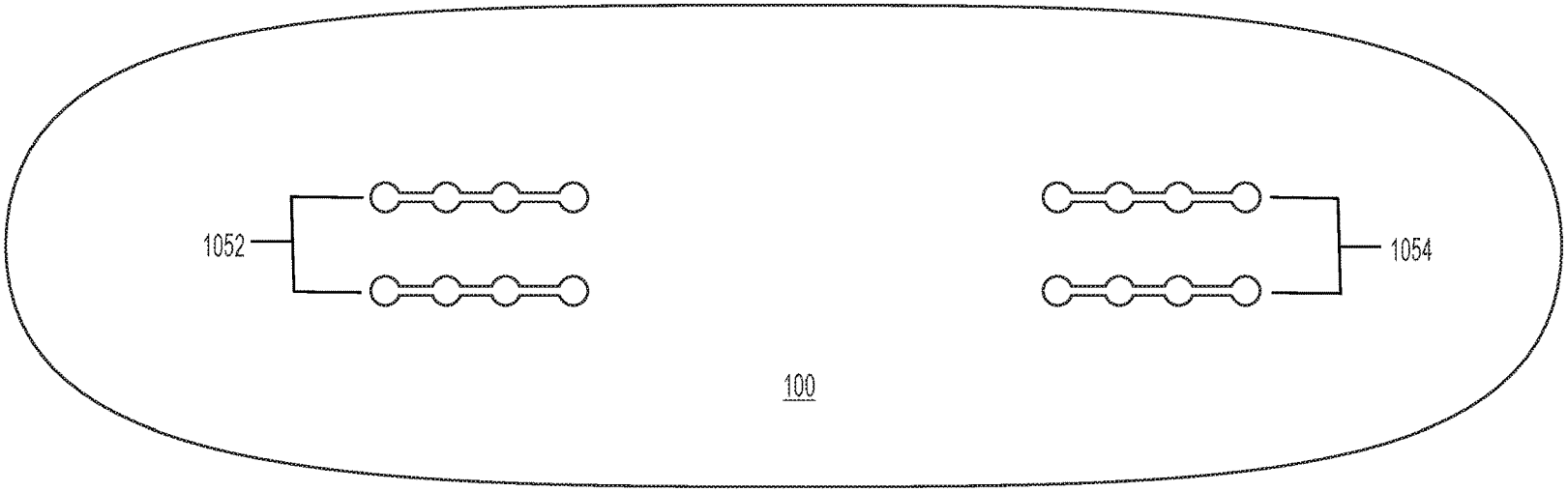

FIG. 11C shows yet another alternative embodiment of board 100. In this embodiment, board 100 has a first pair of longitudinal slots 1052 and a second pair of longitudinal slots 1054. The slots in each pair are the same as the ones described above, with respect to FIG. 11A. FIG. 11C also shows the longitudinal slots in the first pair 1052 arranged parallel to each other, substantially along the longitudinal axis of board 100, and at a distal portion of the board 100. The longitudinal slots in the second pair 1054 are also arranged parallel to each other, substantially along the longitudinal axis of board 100, and at a proximal portion of the board. Each of the slots is adapted to couple a suspension assembly to board 100.

Figure 11D:
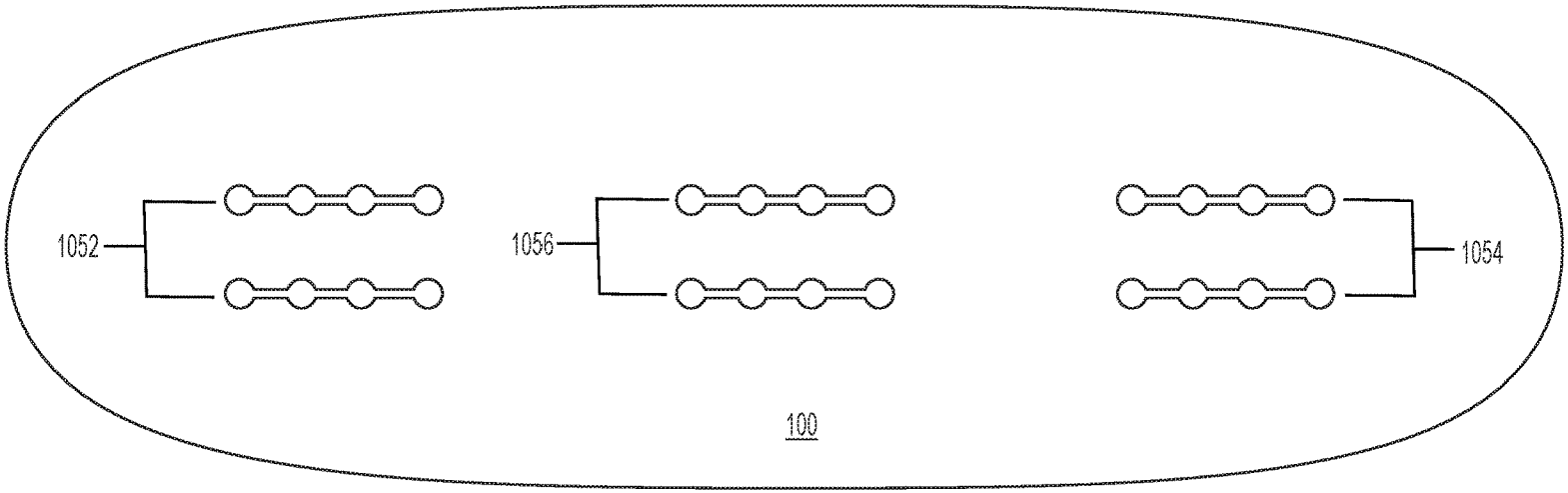

FIG. 11D shows yet another alternative embodiment of board 100. In this embodiment, board 100 has three pairs of longitudinal slots—namely, a first pair of longitudinal slots 1052, a second pair of longitudinal slots 1054, and a third pair of longitudinal slots 1056. The slots in each pair are the same as the ones described above, with respect to FIG. 11A. The only difference between the embodiment of FIG. 11C and FIG. 11D is that the medial portion of board 100 is now provided with a third pair of longitudinal slot 1056. Each of the slots is adapted to couple a suspension assembly to board 100.

Figure 11E:
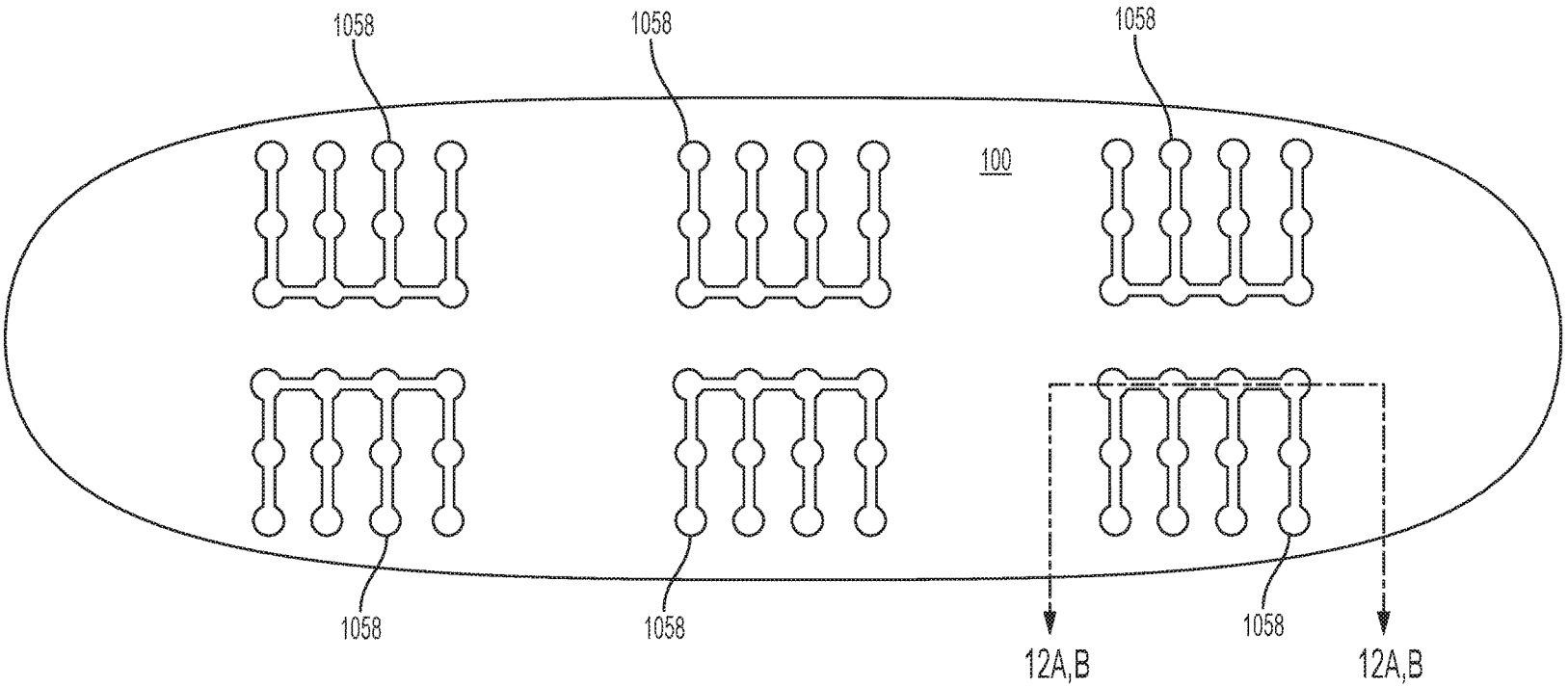

FIG. 11E shows yet another alternative embodiment of board 100. The board in this embodiment is the same as the one shown in FIG. 11D, with the exception that each longitudinal slot is now arranged with a plurality of lateral slots 1058. As further shown in FIG. 11E, each of the slots 1058 extends laterally from a countersunk or counter-bore hole of a longitudinal slot and terminates near an edge of board 100. The lateral slots 1058 allow a user to laterally move a suspension assembly 1000 coupled to board 100, without uncoupling it from the board. Thus, the embodiment of FIG. 11E allows a user to move suspension assembly in both the longitudinal and lateral direction (with respect to the longitudinal axis of board 100) without ever having to uncouple the suspension assembly from board 100. Note that while the lateral slots are shown as perpendicular to the longitudinal slots, they need not be perpendicular, but could be oriented at an obtuse or acute angle with respect to the longitudinal slots, and the lateral or longitudinal slots need not be linear.

Figure 12A:
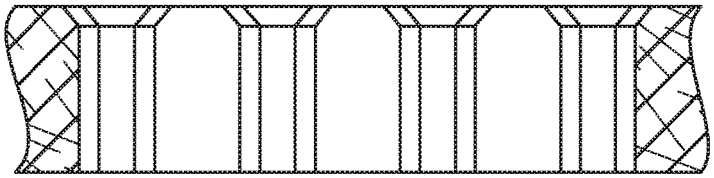
FIGS. 12A and 12B show a cross-sectional view of one or more slots arranged on the board.
Figure 12B:
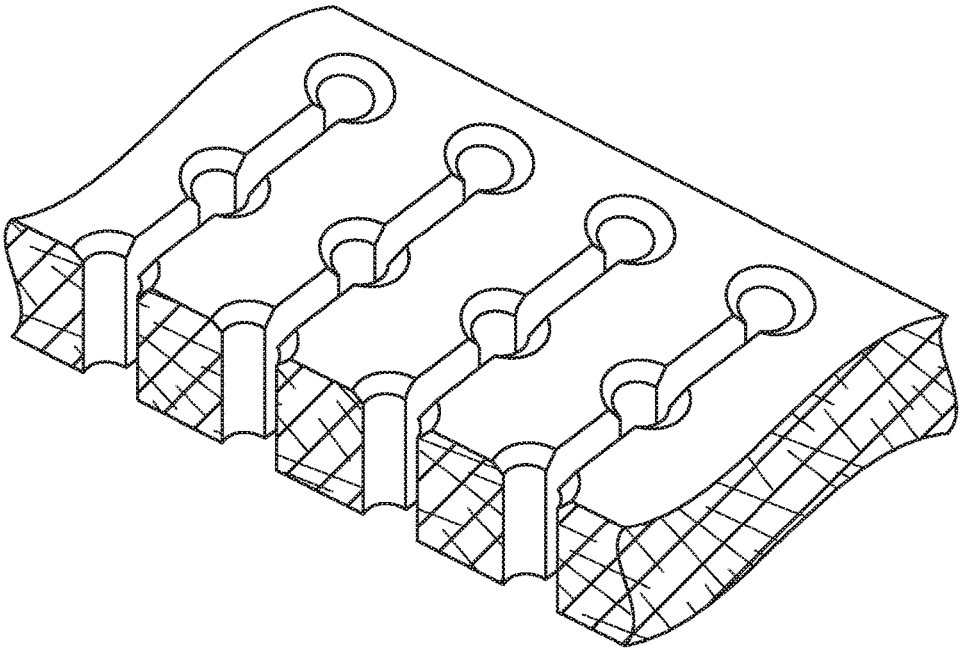

FIGS. 12A and 12B show a cross-sectional view of line 12A,B of FIG. 11E. Each of the countersunk or counter-bore holes of a respective longitudinal slot is connected to adjacent countersunk or counter-bore holes through a channel that allows anchor screw 112 to move freely along its respective longitudinal slot. It should be noted that the cross-sectional view of FIGS. 12A and 12B, showing the channel, applies to the longitudinal slots of FIGS. 11A to 11D as well.

Although the suspension assembly 1000 discussed thus far includes the components shown in FIG. 8, it will be clear to those skilled in the art (after reading this disclosure) how to make and use alternative embodiments of the present invention in which one or more of those components can be omitted from the assembly, while still allowing the training device of the present invention to function as intended. For example, compression member 1016, lower guideway 1018, pedestal 1020, protrusion 1070, etc., can be omitted from the assembly, leaving only deformable member 1014. In this alternative embodiment, deformable member 1014 can be coupled to board 100 (as discussed above, with respect to FIGS. 11A to 11E) and can have a Shore hardness of 60A to 90A. The Shore hardness of deformable member 1014 in this alternative embodiment is resilient enough to radially deform when force is applied to the upper surface of board 100 and deflect board 100 from the ground when the force is removed from the upper surface of the board. The deformable member in this alternative embodiment can be circular- or polygon-shaped.

Figure 15:
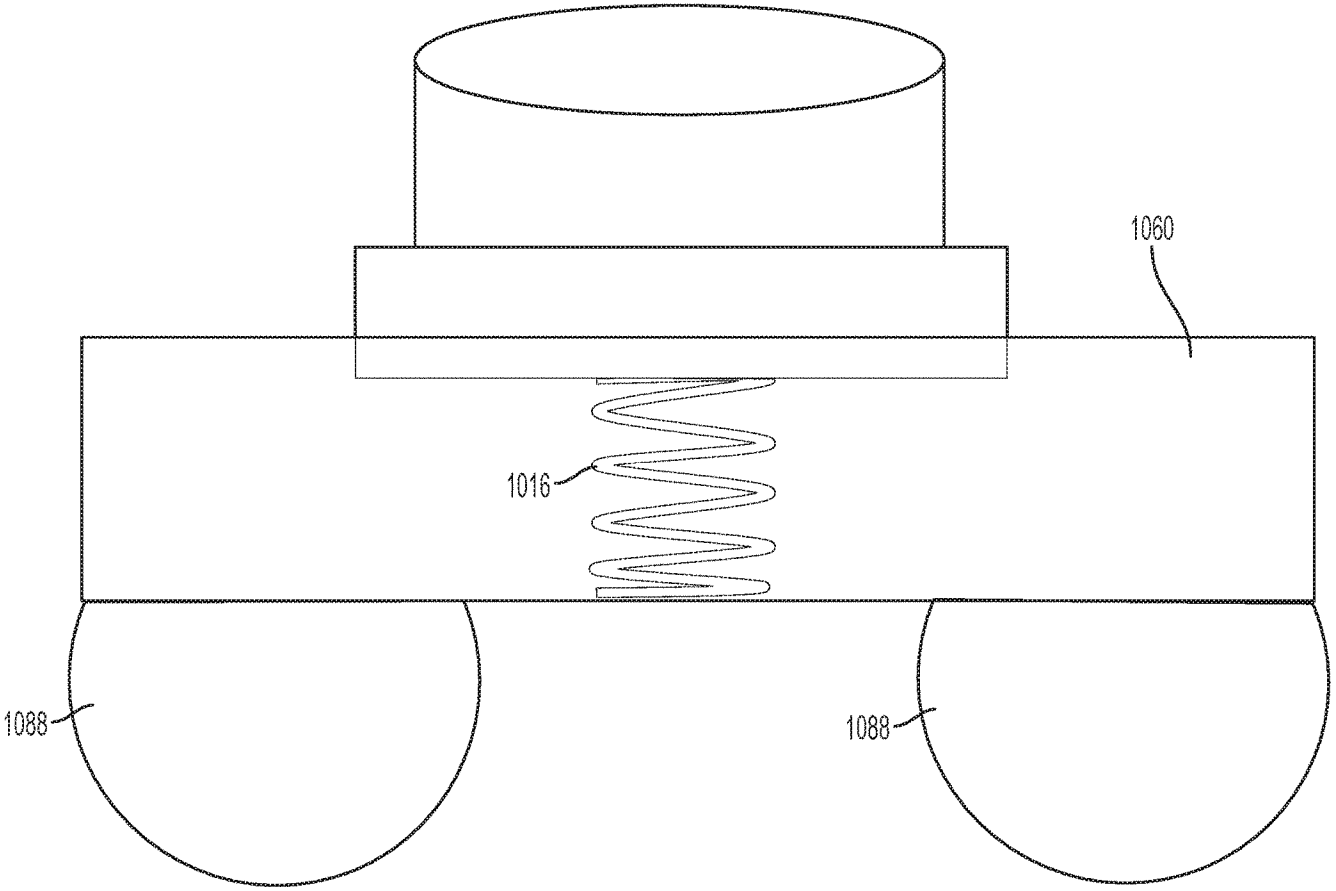
FIG. 15 shows a plurality of suspension assemblies coupled to a support, which in turn is coupled to a plunger that is adapted to be mounted to the bottom surface of a board.
Figure 16:
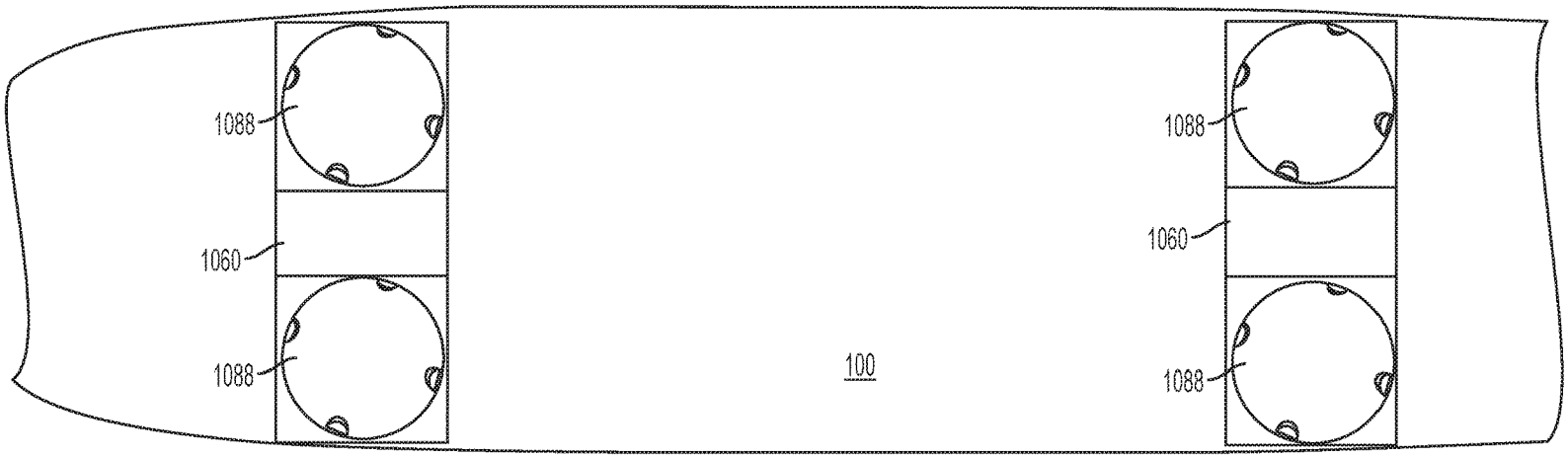
FIG. 16 shows the support having a plurality of suspension assemblies mounted to a board.
Figure 17:
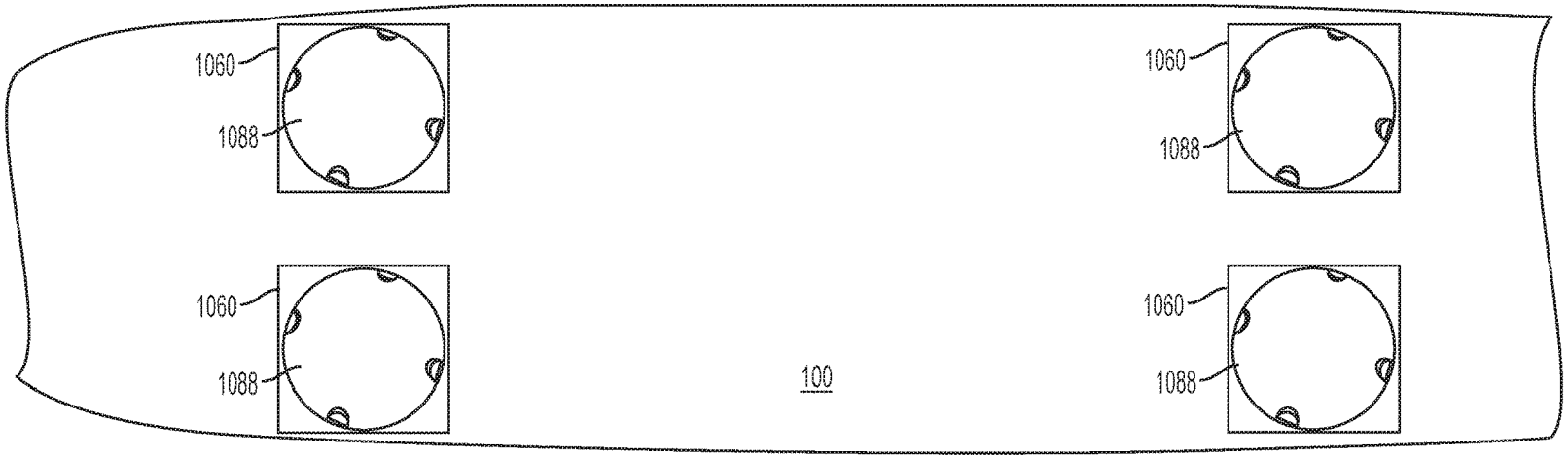
FIG. 17 shows the support having one suspension assembly independently mounted to a board.

Turning now to FIG. 15, this figure shows a plunger coupled to a support platform 1060 (which has an internal spring 1016—e.g., a coil spring, compression-loaded spring, nested coil spring, solid spring, etc.), which in turn is coupled to two deformable members 1088. The plunger shown in FIG. 15 is adapted to be coupled to the bottom surface of board 100 in the same manner discussed above. The deformable members 1088 shown in FIG. 15 are adapted to be screwed onto the bottom surface of support platform 1060. Once support platform 1060 and deformable members 1088 are coupled to each other, the entire assembly is then coupled to the bottom surface of board 100 as a single unit, as shown in FIG. 16. Alternatively, only one deformable member 1088 is coupled to a single support member 1060, which is then individually mounted to the bottom surface of board 100, as shown in FIG. 17.

It will be appreciated by those skilled in the art that the elements depicted in FIGS. 8 to 17 can be the same as, or different from, similarly depicted elements in FIGS. 1-7.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A training device comprising:

a board having an upper surface and a bottom surface; and a plurality of suspension assemblies adapted to be coupled to the bottom surface of the board, wherein each of the plurality of suspension assemblies includes:

(i) a compressible member adapted to be compressed when force is applied to the board by a user and to re-extend when the force recedes; and (ii) a deformable member coupled to the compressible member and adapted to provide compliance in at least one linear dimension; and wherein at least one of the plurality of suspension assemblies is adapted to be coupled to a support member, which in turn is adapted to be coupled to the bottom surface of the board.

2. The training device of claim 1, wherein the board has a plurality of longitudinal slots arranged substantially along a longitudinal axis of the board, with each of the plurality of longitudinal slots is adapted to:

(i) receive an anchor screw for coupling one of the plurality of suspension assemblies to the board, and (ii) allow longitudinal movement of the one of the plurality of suspension assemblies without uncoupling it from the board.

3. The training device of claim 2, wherein each of the longitudinal slots has a plurality of laterally extending slots, with each of the plurality of laterally extending slots is adapted to:

(i) receive the anchor screw for coupling the one of the plurality of suspension assemblies to the board, and (ii) allow lateral movement of the one of the plurality of suspension assemblies without uncoupling it from the board.

4. The training device of claim 3, wherein each of the laterally extending slots is connected to a respective one of the plurality of longitudinal slots for allowing both longitudinal and lateral movement of the one of the plurality of suspension assemblies without uncoupling it from the board.

5. The training device of claim 3, wherein each of the laterally extending slots is connected to a respective one of the plurality of longitudinal slots at a countersunk or counter-bore hole arranged along the respective longitudinal slot.

6. The training device of claim 2, wherein the plurality of longitudinal slots includes:

(i) a first longitudinal slot arranged at a distal portion of the board, and (ii) a second longitudinal slot arranged at a proximal portion of the board.

7. The training device of claim 2, wherein the plurality of longitudinal slots includes:

(i) a first longitudinal slot arranged at a distal portion of the board, (ii) a second longitudinal slot arranged at a proximal portion of the board, and (iii) a third longitudinal slot arranged at a medial portion of the board, the medial portion extending longitudinally between the distal and proximal portions of the board.

8. The training device of claim 2, wherein the plurality of longitudinal slots includes:

(i) a first pair of longitudinal slots, with the longitudinal slots of the first pair being arranged parallel to each other and at a distal portion of the board, and (ii) a second pair of longitudinal slots, with the longitudinal slots of the second pair being arranged parallel to each other and at a proximal portion of the board.

9. The training device of claim 2, wherein the plurality of longitudinal slots includes:

(i) a first pair of longitudinal slots arranged parallel to each other and at a distal portion of the board, (ii) a second pair of longitudinal slots arranged parallel to each other and at a proximal portion of the board, and (iii) a third pair of longitudinal slots arranged parallel to each other and at a medial portion of the board, the medial portion extending longitudinally between the distal and proximal portions.

10. The training device of claim 1, wherein the compressible member has a Shore hardness of 60 to 90 and is made from a solid piece of polyurethane, rubber, plastic, or a combination of polyurethane, rubber, and plastic.

11. The training device of claim 1, wherein the compressible member is a nested coil spring having a first coil spring coaxially arranged within a second coil spring.

12. The training device of claim 1, wherein the plurality of suspension assemblies further includes:

one or more stabilizer screws adapted to limit rotation of the board, with respect to a base, about a yaw axis of the training device.

13. The training device of claim 1, wherein the plurality of suspension assemblies further includes:

one or more stabilizer screws adapted to allow the board to rotate with respect to a base along a pitch and a roll axes, but not along a yaw axis of the training device.

14. The training device of claim 1, wherein the deformable member is adapted to house one or more sensors and light sources, the one or more sensors being configured to detect a change in motion or orientation of the board with respect to a ground and cause the light sources to emit light in response to detecting the change in motion or orientation.

15. A training device comprising:

a board having an upper surface and a bottom surface, wherein the board has:

(i) a plurality of longitudinal slots arranged along a longitudinal axis of the board, and (ii) a plurality of lateral slots, wherein each of the plurality of lateral slots is connected to a respective one of the plurality of longitudinal slots; and a plurality of suspension assemblies, wherein each of the plurality of suspension assemblies is adapted to be slidably coupled to a respective longitudinal and lateral slot of the plurality of longitudinal slots and the plurality of lateral slots, and wherein each of the plurality of suspension assemblies includes:

(i) a compressible member adapted to be compressed when force is applied to the board by a user and to re-extend when the force recedes; and (ii) a deformable member coupled to the compressible member and adapted to provide compliance in at least one linear dimension;

wherein each of the plurality of suspension assemblies is adapted to be independently coupled to the bottom surface of the board.

16. A training device comprising:

a board having an upper surface and a bottom surface, wherein the board has includes:

(i) a plurality of longitudinal slots arranged along a longitudinal axis of the board, and (ii) a plurality of lateral slots, wherein each of the plurality of lateral slots is connected to a respective one of the plurality of longitudinal slots; and a plurality of circular or polygon shaped assemblies, wherein each of the plurality of circular or polygon shaped assemblies is adapted to be slidably coupled to a respective longitudinal and lateral slot of the plurality of longitudinal slots and the plurality of lateral slots, and wherein each of the plurality of circular or polygon shaped assemblies includes a deformable member adapted to provide compliance in at least one linear dimension when force is applied to the board by a user and to re-extend when the force recedes.

17. A training device comprising:

a board having an upper surface and a bottom surface; and a plurality of suspension assemblies adapted to be coupled to the bottom surface of the board, wherein each of the plurality suspension assemblies includes:

(i) a compressible member adapted to be compressed when force is applied to the board by a user and to re-extend when the force recedes;

(ii) a deformable member coupled to the compressible member and adapted to provide compliance in at least one linear dimension; and (iii) a polygon- or circular-shaped base substantially surrounding the deformable member to provide a cushioning effect for the training device upon impact of the board against a ground underneath the polygon- or circular-shaped base, wherein the polygon- or circular-shaped base is adapted to be inflated and deflated to adjust the cushioning effect.

18. A training device comprising:

a board having an upper surface and a bottom surface; and a plurality of suspension assemblies adapted to be coupled to the bottom surface of the board, wherein each of the plurality suspension assemblies includes:

(i) a compressible member adapted to be compressed when force is applied to the board by a user and to re-extend when the force recedes; and (ii) a deformable member coupled to the compressible member and adapted to provide compliance in at least one linear dimension;

wherein the compressible member is integrally formed with a plunger, and wherein the plunger includes:

(i) an upper portion having at least one hole adapted to receive a screw for coupling one of the plurality of suspension assemblies to the bottom surface of the board, the upper portion sized and shaped to slidably engage a through-hole arranged on an upper wall of the deformable member, and (ii) a lower portion integrally formed with the compressible member, the lower portion having a diameter greater than the upper portion to form a shoulder for engaging an underside of the upper wall of the deformable member.

19. The training device of claim 15, wherein each of the plurality of suspension assemblies is adapted to slide along the respective longitudinal and lateral slots of the plurality of longitudinal slots and the plurality of lateral slots without being uncoupled from the board.

20. A training device comprising:

a board having an upper surface and a bottom surface; and a plurality of suspension assemblies adapted to be coupled to the bottom surface of the board, wherein each of the plurality of suspension assemblies includes:

(i) a compressible member adapted to be compressed when force is applied to the board by a user and to re-extend when the force recedes; and (ii) a deformable member coupled to the compressible member and adapted to provide compliance in at least one linear dimension;

wherein each of the plurality of suspension assemblies is adapted to be independently coupled to the bottom surface of the board;

wherein the board has a plurality of longitudinal slots arranged substantially along a longitudinal axis of the board, with each of the plurality of longitudinal slots is adapted to:

(i) receive an anchor screw for coupling one of the plurality of suspension assemblies to the board, and (ii) allow longitudinal movement of a coupled suspension of the plurality of suspension assemblies without uncoupling it from the board; and wherein each of the plurality of longitudinal slots has a plurality of laterally extending slots, with each of the plurality of laterally extending slots is adapted to:

(i) receive the anchor screw for coupling the one of the plurality of suspension assemblies to the board, and (ii) allow lateral movement of the coupled suspension without uncoupling it from the board.

* * * * *